US010893751B2

(12) United States Patent
Dennehy et al.

(10) Patent No.: US 10,893,751 B2
(45) Date of Patent: Jan. 19, 2021

(54) CHAIR BACK

(71) Applicant: Perch Dynamic Solutions Limited, Dublin (IE)

(72) Inventors: Simon Dennehy, County Cork (IE); Philip Hamilton, Dublin (IE)

(73) Assignee: Perch Dynamic Solutions Limited, Dublin (IE)

( * ) Notice: Subject to any disclaimer, the term of this patent is extended or adjusted under 35 U.S.C. 154(b) by 105 days.

(21) Appl. No.: 15/512,487

(22) PCT Filed: Sep. 18, 2015

(86) PCT No.: PCT/EP2015/071514
§ 371 (c)(1),
(2) Date: Mar. 17, 2017

(87) PCT Pub. No.: WO2016/042156
PCT Pub. Date: Mar. 24, 2016

(65) Prior Publication Data

US 2017/0273461 A1 Sep. 28, 2017

(30) Foreign Application Priority Data

Sep. 18, 2014 (GB) ..... 1416500.5

(51) Int. Cl.

| | |
|---|---|
| ***A47C 7/44*** | (2006.01) |
| ***A47C 7/54*** | (2006.01) |
| ***A47C 7/36*** | (2006.01) |
| *A47C 5/12* | (2006.01) |

(52) U.S. Cl.
CPC ..... *A47C 7/44* (2013.01); *A47C 7/36* (2013.01); *A47C 7/54* (2013.01); *A47C 5/12* (2013.01)

(58) Field of Classification Search
CPC .... A47C 5/12; A47C 7/36; A47C 7/44; A47C 7/54; A47C 3/026; A47C 7/40; A47C 7/445
See application file for complete search history.

(56) References Cited

U.S. PATENT DOCUMENTS

| | | | | |
|---|---|---|---|---|
| 3,021,176 A * | 2/1962 | Eads | ..... | A47C 7/32 160/DIG. 15 |
| 3,027,195 A * | 3/1962 | Nelson | ..... | A47C 3/12 297/411.41 |
| 3,046,005 A * | 7/1962 | Raduns | ..... | A47C 7/32 267/110 |

(Continued)

FOREIGN PATENT DOCUMENTS

| | | |
|---|---|---|
| WO | 2002100214 A1 | 12/2002 |
| WO | 2011130264 A1 | 10/2011 |

OTHER PUBLICATIONS

European International Search Report PCT/EP2015/071514 dated Oct. 16, 2015, 4 pp.

(Continued)

*Primary Examiner* — James M Ference
(74) *Attorney, Agent, or Firm* — Daniel J. Chalker; Edwin S. Flores; Chalker Flores LLP

(57) ABSTRACT

A chair back (2) comprising an upper back rest section (2), and a lower section (30) adapted to support the back rest section (2) relative to a chair seat (14), wherein the lower section (30) comprises a pair of resiliently flexible arcuate bands (4).

27 Claims, 18 Drawing Sheets

(56) References Cited

U.S. PATENT DOCUMENTS 4,062,590 A * 12/1977 Polsky ..... A47C 5/06 297/452.2
5,338,094 A * 8/1994 Perry ..... A47C 1/03255 297/286
5,393,126 A * 2/1995 Boulva ..... A47C 5/06 297/440.11
5,411,316 A * 5/1995 Lovegrove ..... A47C 5/12 297/452.15
5,577,811 A * 11/1996 Ogg ..... A47C 3/12 297/284.4
5,810,438 A * 9/1998 Newhouse ..... A47C 7/445 297/286
5,826,940 A * 10/1998 Hodgdon ..... A47C 1/03255 297/303.1
5,871,258 A * 2/1999 Battey ..... A47C 1/023 297/300.2
5,884,965 A * 3/1999 Allen ..... A47C 1/14 297/3
6,296,309 B1 * 10/2001 Kurtz ..... A47C 3/12 297/297
6,345,428 B2 * 2/2002 Apissomian ..... A47C 4/02 29/428
6,523,898 B1 * 2/2003 Ball ..... A47C 1/023 297/284.4
6,702,390 B2 * 3/2004 Stumpf ..... A47C 1/03 297/452.56
6,709,060 B1 * 3/2004 Su ..... A47C 7/40 297/440.2
7,147,286 B2 * 12/2006 Cesaroni ..... A47C 3/04 297/301.1
7,422,287 B2 * 9/2008 Heidmann ..... A47C 7/405 297/284.4
7,665,805 B2 * 2/2010 Ueda ..... A47C 1/03255 297/301.1
7,712,833 B2 * 5/2010 Ueda ..... A47C 1/03255 297/296
7,837,272 B2 * 11/2010 Masunaga ..... A47C 7/282 297/218.1
7,878,591 B2 * 2/2011 Walker ..... A47C 7/46 297/284.4
8,567,864 B2 * 10/2013 Deisig ..... A47C 3/045 297/285
8,708,418 B2 * 4/2014 Mizobata ..... B60N 2/5825 297/440.2
2002/0140276 A1 * 10/2002 Funk ..... A47C 5/12 297/452.63
2003/0001420 A1 * 1/2003 Koepke ..... A47C 1/03255 297/440.15
2003/0107252 A1 * 6/2003 Kinoshita ..... A47C 3/12 297/301.1
2004/0189073 A1 * 9/2004 Chadwick ..... A47C 1/023 297/383
2004/0262975 A1 * 12/2004 Su ..... A47C 5/06 297/440.11
2005/0116527 A1 * 6/2005 Leguen ..... A47C 3/02 297/452.56
2005/0242652 A1 * 11/2005 Kepler ..... A47C 7/14 297/452.56
2005/0269848 A1 * 12/2005 Harley ..... A47C 31/02 297/230.1
2007/0108819 A1 * 5/2007 Ueda ..... A47C 7/443 297/292
2007/0114833 A1 * 5/2007 Hou ..... A47C 7/32 297/452.64
2008/0211277 A1 * 9/2008 Goetz ..... A47C 7/46 297/230.14
2009/0102268 A1 * 4/2009 Schmitz ..... A47C 1/03255 297/452.19
2009/0146476 A1 * 6/2009 Kan ..... A47C 1/03255 297/284.4
2009/0195047 A1 * 8/2009 Bouche ..... A47C 3/04 297/452.14
2009/0261644 A1 * 10/2009 Piretti ..... A47C 7/282 297/344.12
2010/0072799 A1 * 3/2010 Peterson ..... A47C 3/12 297/285
2010/0176646 A1 * 7/2010 Rowland ..... A47C 5/06 297/452.56
2010/0259089 A1 * 10/2010 Mizobata ..... B60N 2/7011 297/452.56
2010/0264708 A1 * 10/2010 Rajaratnam ..... A47C 1/022 297/284.2
2011/0089740 A1 * 4/2011 Dennehy ..... A47C 7/029 297/452.1
2011/0101748 A1 * 5/2011 Goetz ..... A47C 7/462 297/284.4
2011/0198909 A1 * 8/2011 Fifield ..... A47C 7/32 297/452.56
2011/0285191 A1 * 11/2011 van Hekken ..... A47C 3/04 297/299
2012/0007400 A1 * 1/2012 Behar ..... A47C 7/40 297/284.4
2013/0082499 A1 * 4/2013 Schmitz ..... A47C 1/03255 297/285
2013/0088065 A1 * 4/2013 Narita ..... A47C 7/30 297/452.18
2013/0169017 A1 * 7/2013 Masunaga ..... A47C 1/03255 297/320
2014/0117732 A1 * 5/2014 Bachar ..... A47C 7/46 297/285
2014/0319890 A1 * 10/2014 Rivera ..... A47C 7/467 297/284.4
2015/0173514 A1 * 6/2015 Kikuchi ..... A47C 31/02 297/451.9
2015/0245714 A1 * 9/2015 Schneider ..... A47C 1/03255 297/300.5
2016/0015179 A1 * 1/2016 Bonneywell ..... A47C 1/024 297/258.1
2016/0106216 A1 * 4/2016 Mehaffey ..... A47C 3/12 297/452.14
2017/0273461 A1 * 9/2017 Dennehy ..... A47C 7/44

OTHER PUBLICATIONS

European International Search Report PCT/EP2015/071514 dated Oct. 16, 2015, 10 pp.

* cited by examiner

CHAIR BACK

CROSS-REFERENCE TO RELATED APPLICATIONS

This application is the National Stage Application under 35 U.S.C. § 371 of International Application No. PCT/EP/2015/071514, filed on Sep. 18, 2015, which claims priority to GB1416500.5, filed Sep. 18, 2014. The contents of the foregoing applications are hereby incorporated by reference in their entirety.

FIELD OF THE INVENTION

The field of the invention is chairs, in particular task chairs.

BACKGROUND TO THE INVENTION

Task chairs have evolved over the years to better support and improve the occupant's ability to adjust and move while working. Continuous movement, throughout the course of the working day, is a consideration for providing workers with a healthier environment, as opposed to sitting statically for prolonged periods of time.

Increasing work practices now involve working in areas away from the conventional desk, when where mobile technologies such as phones, tablet and laptops are the norm. In many situations, occasional chairs are used in breakout areas and meeting rooms for prolonged periods of time. There is also a move towards offering workers a sit to stand desk solution, so they may adjust the height to suit their requirements. There is a great difference in height however between sitting and standing and also a vast difference in posture, comfort and effort to move seamlessly between the two.

It is an aim of the invention to find a simplistic solution for workers performing light tasks, who wish to move frequently, sit in various positions, while only requiring an adjustment for height function.

The invention was created from an ambition to create a very simple office chair, which offers a variety of supported sitting postures to the occupant, from upright to reclined seating, which could be achieved without the need for a traditional mechanism beneath the seat pan. In order to eliminate the mechanism it was necessary to reconsider the locations of movement and flexing for the reclined function. In most traditional task chairs, the majority of movement is controlled from pivot points below the seat pan and stiffened with springs and tensioners.

SUMMARY OF THE INVENTION

According to the present invention there is provided a chair back comprising an upper back rest section; and a lower section adapted to support the back rest section relative to a chair seat, wherein the lower section comprises a pair of resiliently flexible arcuate bands.

Preferably the pair of resiliently flexible arcuate bands form the only form of support between the back rest and a chair seat to which the chair back may be connected. Preferably the pair of resiliently flexible arcuate bands form the only connection between the back rest and a chair seat to which the chair back may be connected. Preferably the upper back rest section connects, or links, the resiliently flexible arcuate bands of the lower section. Preferably the upper back rest section is formed from at least one band.

The back rest section may be formed as a band linking the two arcuate bands of the lower section. Such a band of the back rest section may be inflexible, and/or unyielding and/or stiff and/rigid. The band may be flexible but not resiliently flexible. However, preferably the back rest section is formed from at least one resiliently flexible band. A resiliently flexible band will maximise the performance of the chair back. Preferably the back rest section comprises a bent band which has at least two changes in direction along its length. The band may contain two substantially right angle turns or bends between its two ends. The band may have two corners between which a back-engaging surface is defined. The chair back (the back rest section) may comprises a central portion and two side arms. Preferably the central portion and two side arms are formed from a single resiliently flexible band. The back rest section and the lower section may be formed from a single resiliently flexible band.

Preferably the band from which any part of the chair back is formed is like a strip or ribbon, being long, flat and narrow. Preferably the band from which the upper back rest section is formed has a ribbon form. The band from which the upper back rest section is formed may undergo at least one twist along its length. Alternatively or additionally the band from which the upper back rest section is formed may have at least one bend along its length. Preferably the band from which the upper back rest section is formed has a ribbon form which undergoes at least one twist and at least one bend along its length.

In one embodiment the resiliently flexible band has a ribbon shape with a substantially rectangular cross-section. It is however possible for the band to have any shape cross-section for example a circular or oval cross section. The band may be reinforced internally or on an outer surface to impart additional resistance against bending to certain regions of the band. The upper back rest section and the lower section together form a frame. Preferably the frame defines a central aperture or opening in the seat back, wherein the frame defines the perimeter of an "open" chair back. A back panel may be used in a portion of the central aperture without departing from the "open" nature of the chair back. Preferably the back rest section defines the upper and side perimeter of an open chair back.

The back rest may comprise a back engaging surface which lies in a substantially perpendicular plane to that of the ends of the two side arms at the elbow rests. The back rest section is preferably intended for contact with a back of a user, whereas the lower section is not intended for contact with the user, rather to provide a connection to a chair base or seat.

Preferably each resiliently flexible arcuate band of the lower section is sprung to resiliently flex. Preferably each resiliently flexible arcuate band of the lower section has a substantially C-shape form. By substantially C-shaped, it is meant that for at least a portion of the band, the measure of the arc is greater than 90 degrees, preferably greater than 120 degrees. The measure of the arc could be in the region of 180 degrees or more. It is not essential for the ends to lie in a common plane like in a uniform "C". Nor is it required that the C-shape is symmetrical. It is possible for an end of the arc to undergo a change of direction rather than follow the arc, for example an end might start to become planar. The C-shape may open out to a more open C-shape as a user reclines. In this case, it is possible that the resultant open measure of the arc could be less than 90 degrees. Preferably, when at rest, each resiliently flexible arcuate band of the lower section turns back on itself rather than simply undergoing an upwards bend rearward of the seat, such that its ends point in a direction having a forward component (relative to the user's intended seat position).

Two elbow rests may be formed at the connection of the back rest section to the lower section. The pair of resiliently flexible arcuate bands of the lower section may converge distal to the elbow rests. This allows the bands to converge towards a single chair-connection point, two separated chair-connection points, or adjacent chair-connection points or co-located chair connection points to which a chair may be connected. In one embodiment the pair of resilient bands are arcuate portions of a single resilient band forming the lower section.

A portion of an upper face of each resiliently flexible arcuate band may engage with a portion of the underside of a side section of the back rest section to form an elbow rest. A portion of each resiliently flexible arcuate band may merge with a portion of a side section of the back rest section to form an elbow rest. The merged portions may be integrally moulded.

By "upper face" is meant the outer face of the arc of the resiliently flexible arcuate band. The underside of the side section of the upper section would be the opposing face to that which would support an elbow.

The chair back may further comprise a back panel. The back panel may be held under tension. According to one embodiment, the back panel has connection points to the back rest section, and to each resiliently flexible arcuate band of the lower section. The back panel may be formed from a single piece of fabric. The back panel may be formed from a single piece of flexible material. The back panel may be formed from multiple strips of fabric or other flexible material. The back panel may be formed from a mesh or a net. The back panel may be non-flexible.

Preferably the back panel is formed from multiple strands. Preferably the multiple strands are multidirectional to form a net-like support. The multiple strands may be connected to at least one resiliently flexible arcuate band by way of holes in the resiliently flexible arcuate band. The strands may be threaded through the holes directly or via connectors. The multiple strands may envelope a portion of the back rest section. In particular, the back panel may envelope a portion of the back rest section. In a preferred embodiment one end of all of the multiple strands converge to a first connection point on one of the resiliently flexible arcuate bands and the other end of all of the multiple strands converge to a second connection point on the other of the resiliently flexible arcuate bands. Each strand may extend upwards from one of the two connection points, around the back rest section and downwards to the other of the two connection points. Each strand may cross itself between the two connection points. Means may be provided to adjust the tension in the back panel to alter the lumber support provided by the back panel. The strand may be formed from various materials, from wire, to ribbons, to rope to string to strips of material or plastic or natural materials such as leather.

The present invention provides a chair back that promotes continuous, self-adjusted sitting that enables the occupant to achieve a variety of postures—from reclined, low sitting to upright, high perch sitting. It can be used with a chair having only one adjustment lever, namely a height adjustment lever. The chair back relies on strategically configured bands (beams) and which are made from a resilient material. This material is highly elastic and always returns to its original form, once unloaded. Once loaded by the weight of the user, it deforms and resiliently flexes to the preferred style of position for the occupant. The chair back is intended for fixed/secure attachment/mounting to a chair base. The flexible nature of the chair back itself dispenses with the need for a pivotable or otherwise displaceable attachment with a chair base, or an adjustable connection with a chair base.

The present invention further provides a chair incorporating the aforementioned chair back, i.e. a chair comprising: a seat section comprising a seat pan; and a chair back comprising an upper back rest section; and a lower section adapted to support the back rest section relative to a chair seat, wherein the lower section comprises a pair of resiliently flexible arcuate bands. Preferably the resiliently flexible arcuate bands are attached via a fixed connection to the seat section. The chair of the invention may incorporate any of the aforementioned features or characteristics of the chair back as set out above or in the appended claims, in any combination.

BRIEF DESCRIPTION OF THE DRAWINGS

Embodiments of the invention will be described, by way of example only, with reference to the accompanying drawings in which.

DETAILED DESCRIPTION OF THE DRAWINGS

Figure 1:
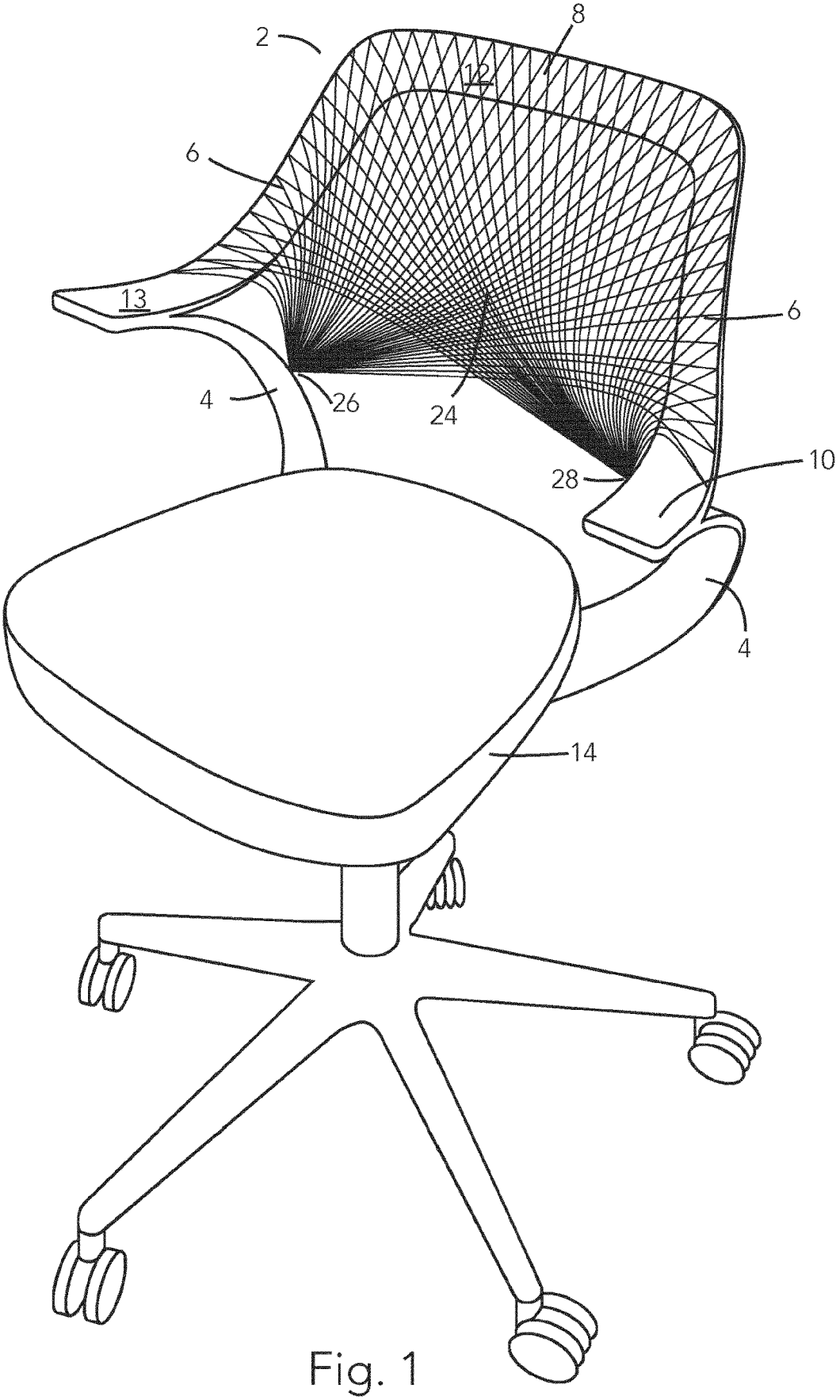
FIG. 1 is a perspective view of a chair incorporating a chair back in accordance with one embodiment of the present invention.

FIG. 1 is a perspective view of a chair incorporating a chair back in accordance with one embodiment of the present invention.

It is shown in FIG. 1 how the backrest section 2 and the resiliently flexible arcuate bands 4 of the lower section form a back support assembly for a chair, in this instance a task chair suitable for an office. The chair back of the invention can be used with any sort of chair, with any seat and base arrangement, and is not limited for use with a wheeled chair or a task chair such as that shown in the figures.

In the embodiment shown in FIG. 1, the ends of the side arms 6 of the backrest section lie in a substantially perpendicular plane to that of the central portion. The central portion 8 supports the upper back of the user in use. The side arms gradually diverge in this embodiment towards the elbow rests 10. As seen from FIG. 1, with the chair at rest, the user-engaging face 12 of the centre section 8 of the backrest section is substantially vertical, inclined slightly rearwardly for comfort. The user-engaging face 13 of the ends of the side arms 6 is substantially horizontal to allow an elbow to rest thereon.

Figure 2:
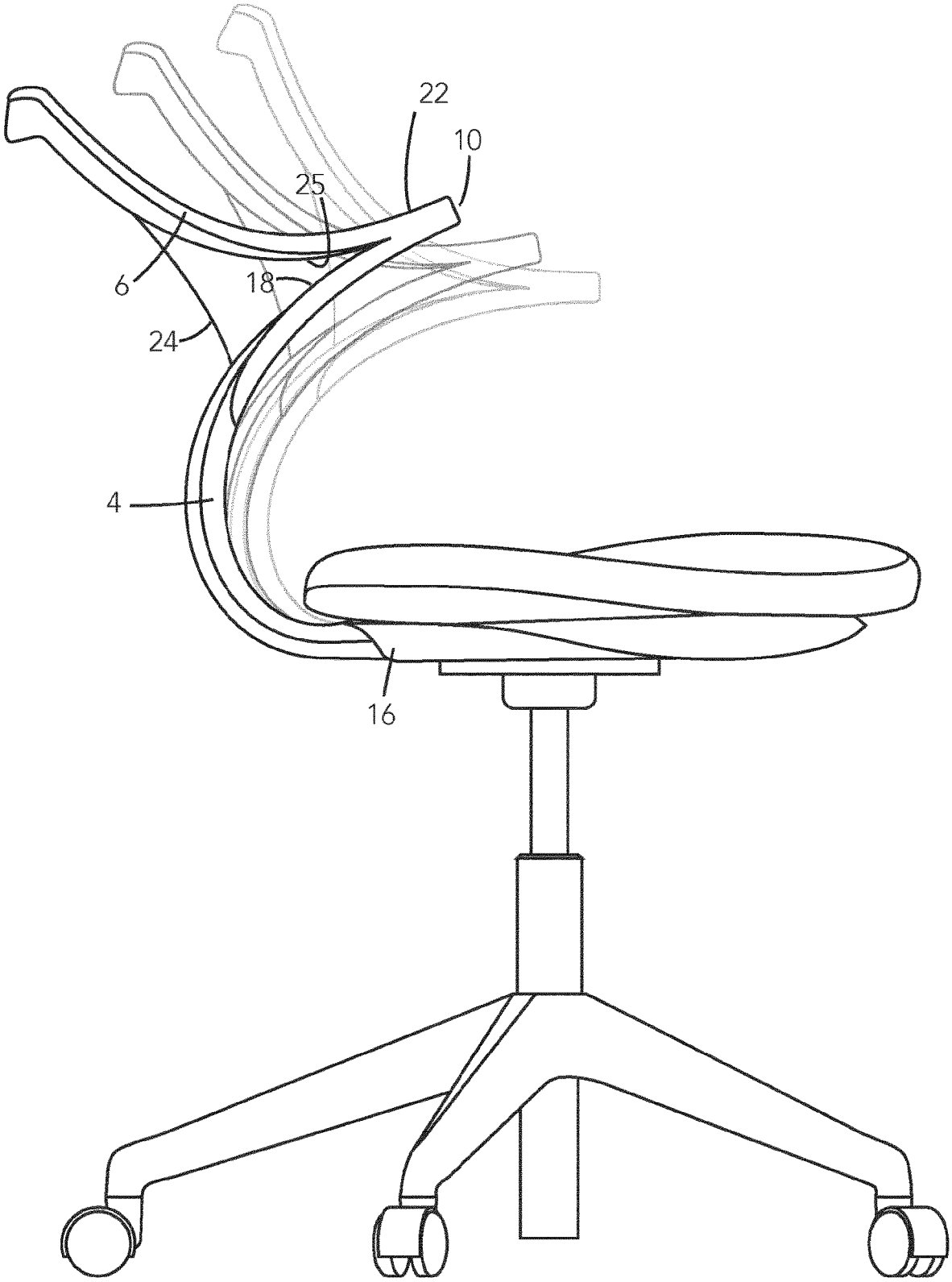
FIG. 2 is a side view of the chair of FIG. 1 showing three positions of increasing reclining.

As seen from FIG. 2, in cross-section along an axis running from one side of the chair to another, a portion of side arm 6 of the backrest section has an arcuate form.

As best seen in FIG. 2, but also shown in FIG. 1, each resiliently flexible arcuate band 4 of the lower section has a substantially C-shape form. By arcuate it is meant that each is bent like an arc or bow, in other words, bowed. Each band 4 can be seen to curve in a forward direction, to form a forward C-shape relative to the direction of seating. The resiliently flexible arcuate bands of the lower section can be seen in FIG. 1 to converge from the elbow rests 10 towards the underside of the seat 14. The connection point 16 to the chair under the seat is shown in FIG. 2. From its seat/chair connection point, each band 4 extends in a backwards direction away from the connection point before curving upwards. The curvature continues throughout the middle portion of band 4 until the band 4 begins to curve forward towards the end distal to the seat connection point. As also seen in FIG. 2, when viewed from the side, the back rest section is arcuate also, as the side arms 6 of the back rest curve backwards and upwards from the lower section connection point.

When seen in combination with a seat, it will be appreciated that each resiliently flexible arcuate band 4 of the lower section is in effect an arm extending upwards from the seat. The arms are connected together by a strip which forms a backrest, in this embodiment a single strip, although the strip could have multiple parts in alternative embodiments. So the pair of resiliently flexible arcuate bands could be described as a pair of arms. The upper back rest section could be described as a strip connecting the pair of arms. This strip supports the back of the user in use.

As shown in FIG. 2, each resiliently flexible arcuate band 4 of the lower section is sprung to resiliently flex (to deform) to recline the chair under a user's weight. It can be seen in FIG. 2 how the "at-rest" C-shape opens or flexes or deforms out to a more open C-shape as the back is reclined. The resiliently flexible arcuate bands 4 are biased to the most closed C shape shown in FIG. 2, and will therefore return to this position after deforming or bending or stretching. In this respect they are elastic or sprung.

In this embodiment, a portion of an upper face 18 of each resiliently flexible arcuate band 4 engages with the underside 25 of a portion of side arm of the backrest section that forms the elbow rest.

One end 20 of each resiliently flexible arcuate band merges with an end 22 of the side arm of the backrest section to form the elbow rest. In this embodiment, the merged ends 20, 22 have been integrally moulded.

The chair back of FIGS. 1 and 2 comprises a back panel 24 to provide additional support to a user. The back panel is tensioned and has connection points to the backrest section, and to each resiliently flexible arcuate band of the lower section. The back panel provides additional back support to the user but does not impact on the flexibility of the chair back frame. The frame created by the back rest section and the lower section is not restricted in any way when a back panel is connected. The back panel is formed from multiple strands, which are multidirectional to form a net-like support. As shown in FIG. 1, the multiple strands envelope a portion of the backrest section.

As shown, one end of all of the multiple strands converge to a first connection point 26 on one of the resiliently flexible arcuate bands 4 of the lower section and the other end of all of the multiple strands converge to a second connection point 28 on the other of the resiliently flexible arcuate bands 4 of the lower section. The strands in effect fan outwards away from the connection points 26, 28.

Figure 18:
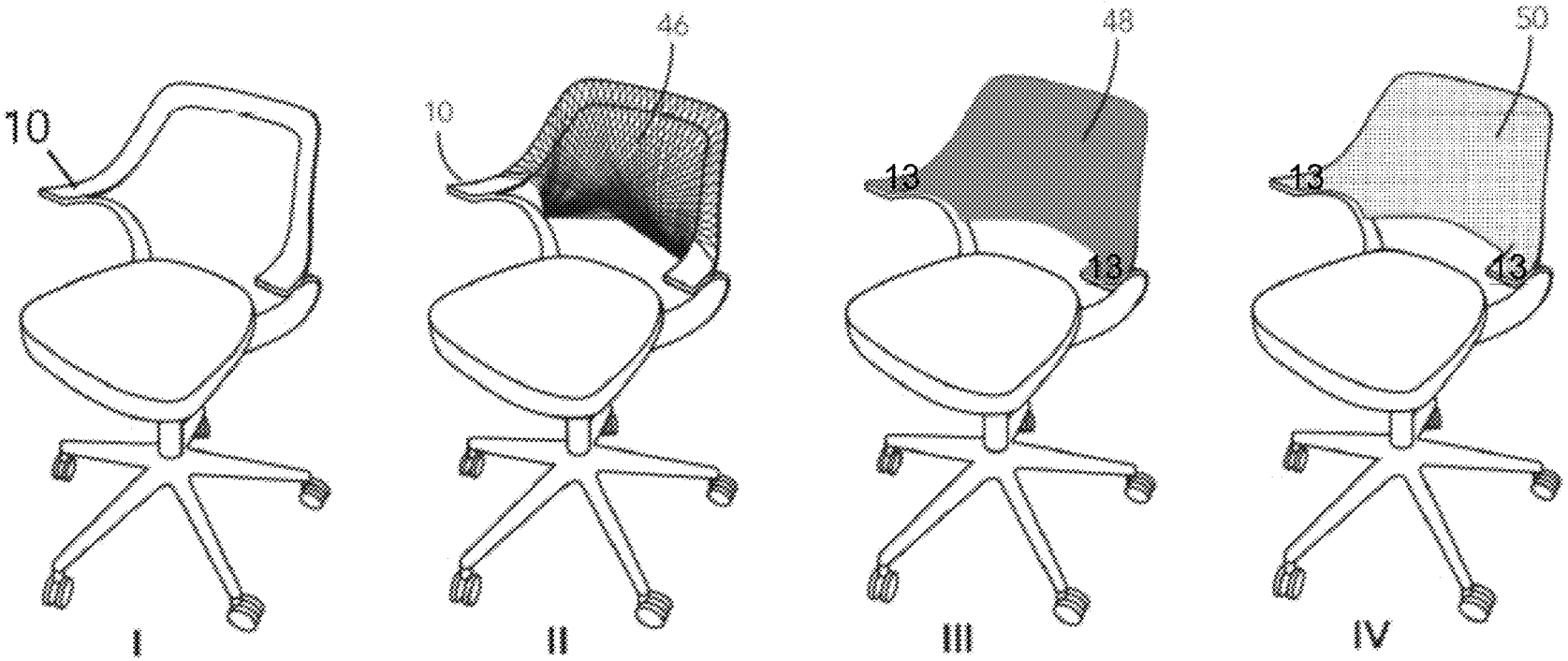
FIG. 18 shows perspective views of four example embodiments of chair backs in accordance with the present invention.

Each strand extends upwards from one of the two connection points, around the backrest section and downwards to the other of the two connection points. Each strand therefore crosses itself between the two connection points. Various other forms of back panel may be used with the chair back of FIGS. 1 and 2. Examples of other forms are shown in FIG. 18.

Figure 3:
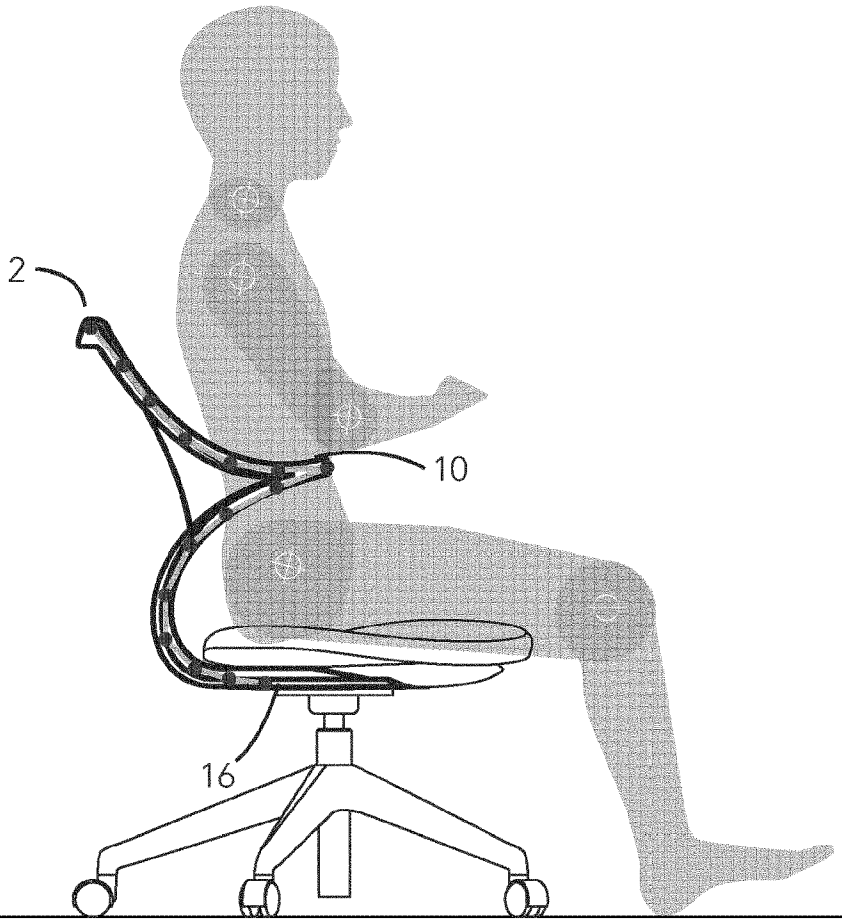
FIG. 3 is a side view of a chair incorporating a chair back in accordance with one embodiment of present invention, showing a user in a disengaged position.

FIG. 3 is a side view of a chair incorporating a chair back 2 in accordance with one embodiment of present invention, showing a user in a disengaged position. The user is not engaged with the back rest 10, although the user is shown to be able to lower his elbows onto the elbow rests. The lower section retains its at-rest closed C form, the upper section is also at rest. It can be seen that in this embodiment, the connection point 16 between the lower section of the seat back and the chair is directly below the centre of gravity of the user.

Figure 4:
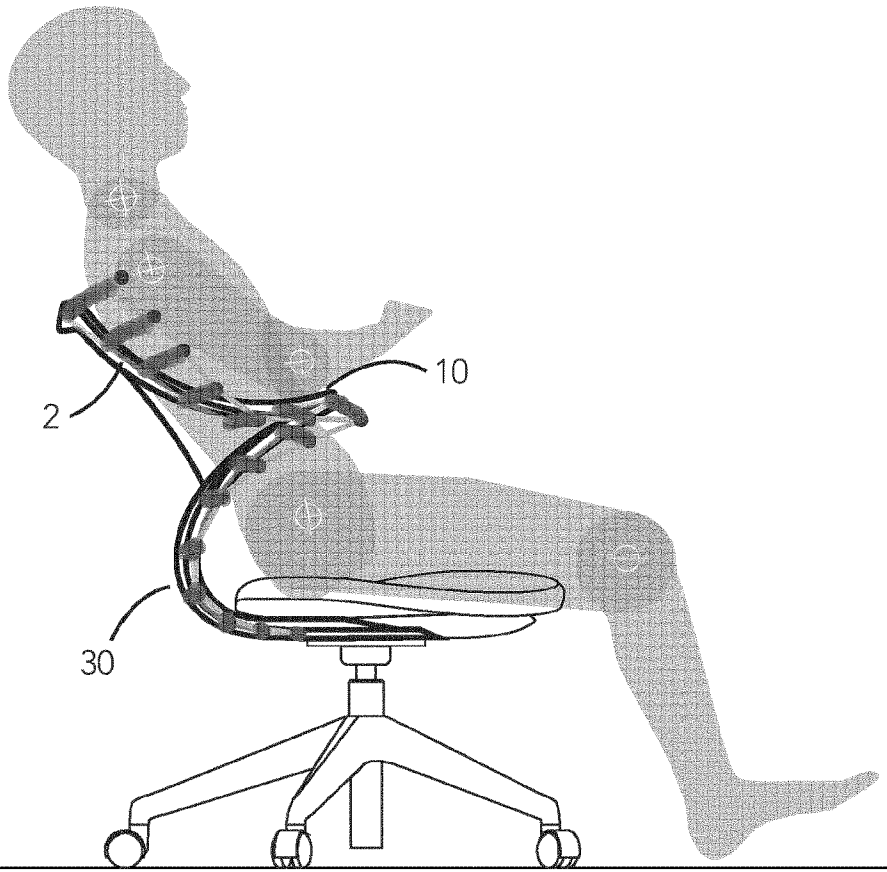
FIG. 4 is a side view of the chair of FIG. 3, showing a user in a full reclined position.

In FIG. 4, the user has moved to a natural resting position. Through leaning back the user has flexed the chair back, forcing the back rest section 2 backwards and downwards (shown by the movement lines). As seen in FIG. 4, the elbow rests 10 have also moved upwards and backwards as the C of the lower section 30 flexes and opens up. This displacement is shown in detail in FIG. 8III, and in FIGS. 9, 10V to 10VIII, 11 and 12. In this embodiment, the elbow rests remain in a similar position relative to the user. As such, the user can comfortably rest his elbows on the elbow rests in this position.

Figure 5:
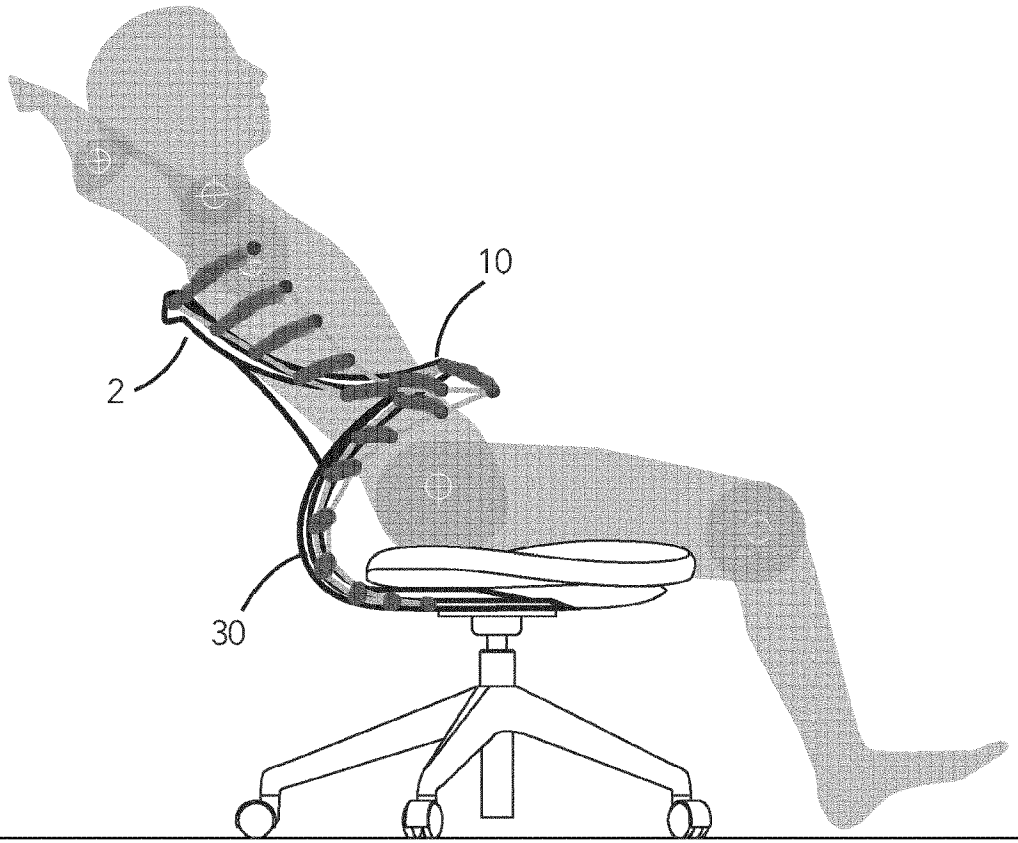
FIG. 5 is a side view of the chair of FIG. 3, showing a user in a natural resting position.
Figure 16:
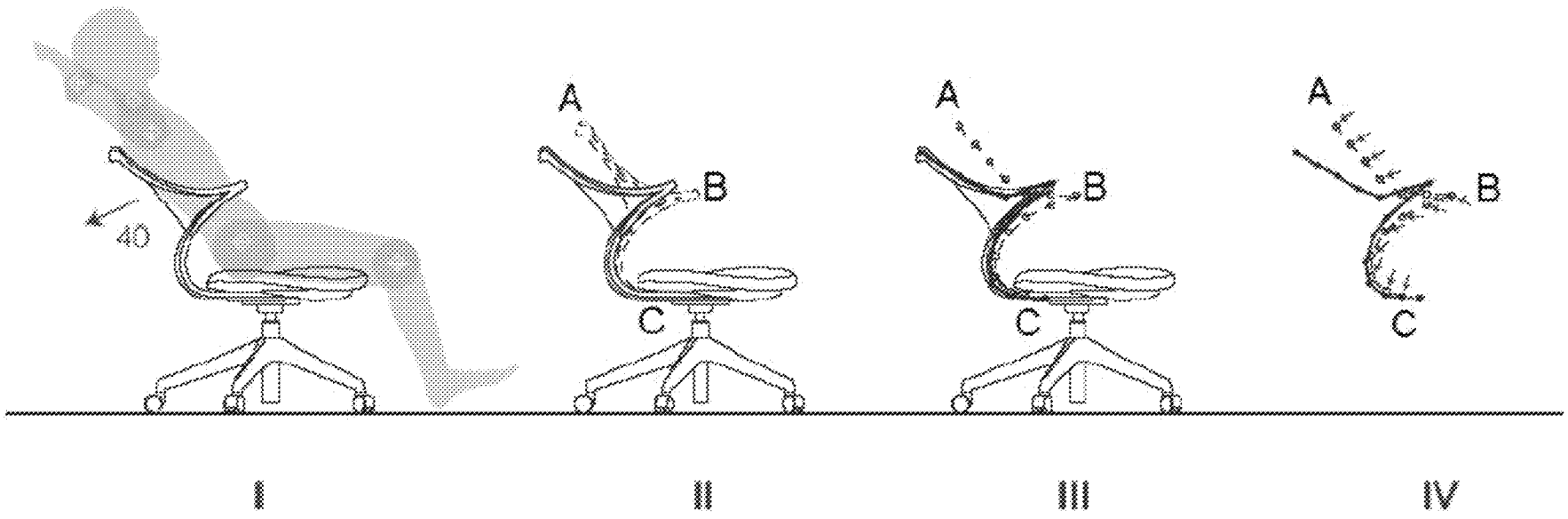
FIG. 16 is a side view of the chair FIG. 8 in an in-use and vacant condition whilst in a full reclined position, and the displacement from a neutral backrest position.

In FIG. 5, the user has reclined further into a fully reclined position. Through leaning back further the user is forcing the back rest section 2 even further backwards and further downwards (shown by the movement lines). The elbow rests 10 have likewise moved further upwards and further backwards as the C of the lower section 30 flexes more and opens up further. This displacement is shown in detail in FIG. 16. It can be seen although the use has his arms over his head in this figure that the elbow rests 10 remain in a similar position relative to the user. As such, the user could still comfortably rest his elbows on the elbow rests in this position.

Figure 6:
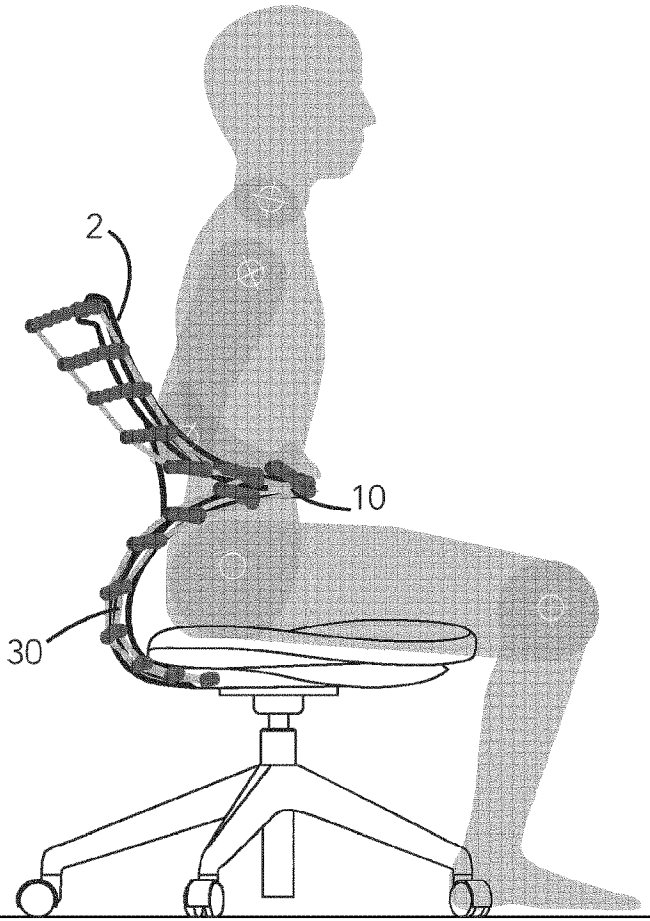
FIG. 6 is a side view of the chair of FIG. 3, showing a user about to stand.
Figure 17:
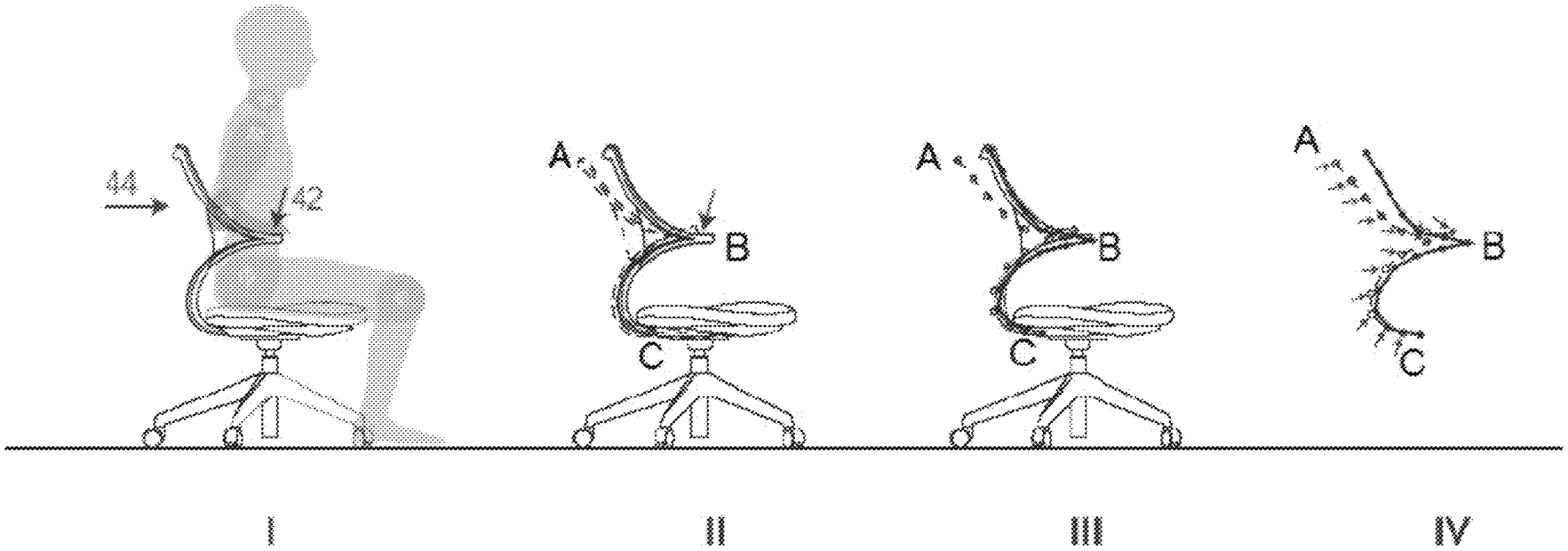
FIG. 17 is a side view of the chair of FIG. 8 in an in-use and vacant condition whilst in a dismounting position, and the displacement from a neutral backrest position.

FIG. 6 is a side view of the chair of FIG. 3, showing a user about to stand. The movement lines show movement from the disengaged position of FIG. 3, the movement effected by the user pushing down on the elbow rests with his hands. As a result of the downward force of the upper body weight onto the elbow rests, the C-shape form of the lower section 30 closes as the elbow rests move down and slightly forward. The whole of the lower section undergoes an opposite translation to that experienced upon recline. Likewise, the upper section backrest 2 undergoes an upwards and forwards translation and imparts an upward and forward force on the user assisting them with moving from a sit to an upstanding position. Further details of the sit to stand motion are shown in FIG. 17.

Figure 7:
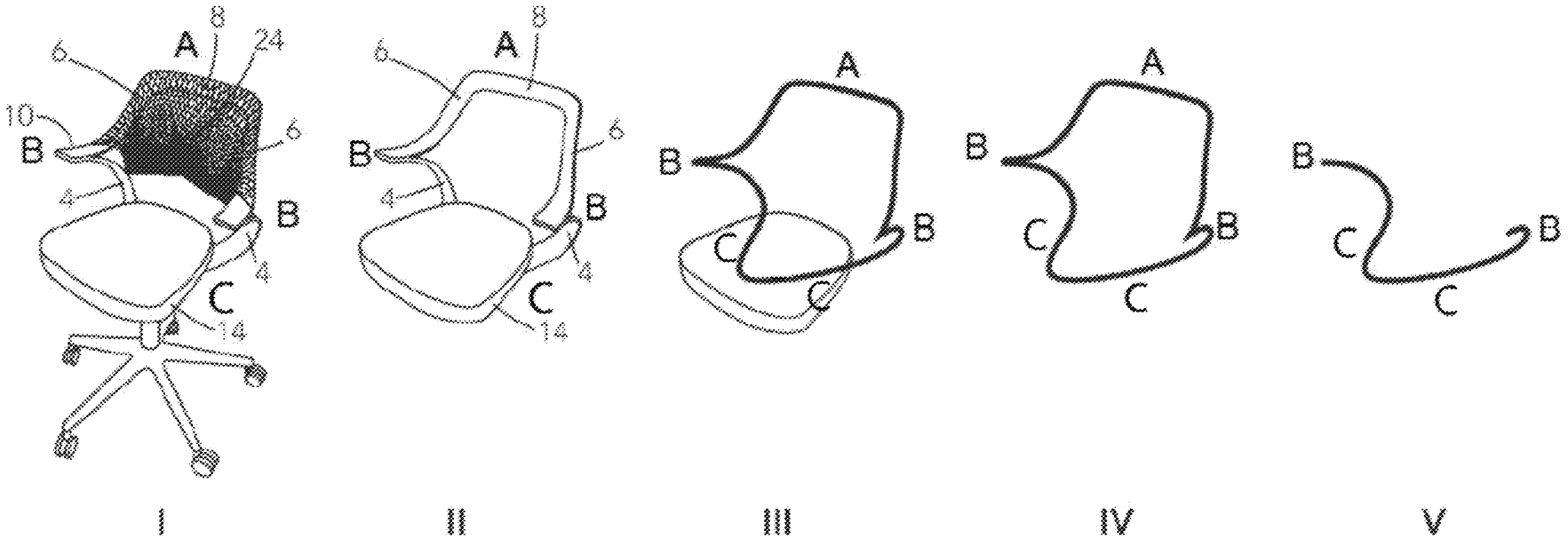
FIG. 7 is a breakdown of the chair of FIG. 1.

FIG. 7I shows the chair of FIG. 1. FIG. 7II shows the chair back of FIG. 7I without its back panel 24 and in combination with the seat pan 14 of FIG. 7I. FIG. 7III identifies the chair back perimeter shape and position relative to the seat pan. In this embodiment the lower section has a continuous form wherein the two resiliently flexible arcuate bands 4 of the lower section are linked by a lower centre section. This continuous form is not essential. In other embodiments the two resiliently flexible arcuate bands have lower free ends which are secured in close configuration when in use. The converging of the resiliently flexible arcuate bands of the lower section of the chair back is more important, than whether they are interlinked or separated. As represented in FIGS. 7II to 7IV, the form of the chair back of the invention could be considered as a single undulating band having two changes in direction at points B, or two undulating bands, the ends of one band being connected to the ends of the second band at points B.

FIG. 7IV shows the chair back perimeter alone. FIG. 7V shows the lower section of the chair back perimeter. Throughout FIGS. 7III to V the centre section 8 of the backrest 2 section is denoted by A, the elbow rests 10 are denoted by B and the lower section resiliently flexible arcuate bands 4 backrest denoted by C.

Figure 8:
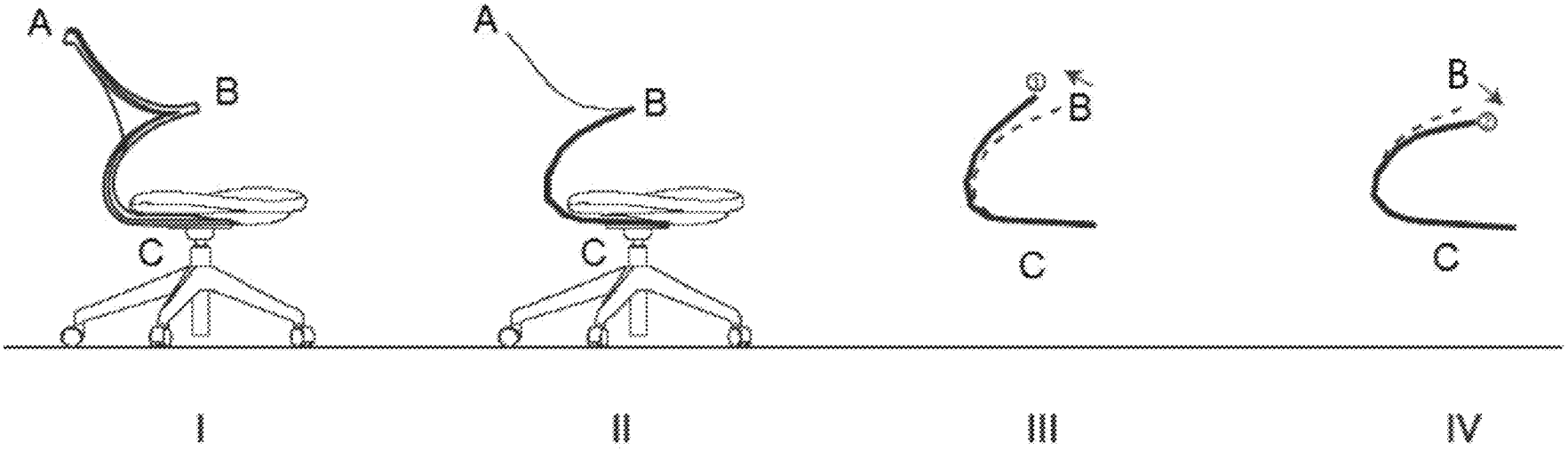
FIG. 8 is a side view of a chair incorporating a chair back in accordance with one embodiment of the present invention showing an opening and closing of the lower section of the chair back.

FIG. 8 further identifies the backrest shape. In FIG. 8I, the upper section is defined between point A and point B, and the lower section defined between point B and point C. FIG. 8II identifies the shape of the chair back, highlighting the lower section forming a C-shape. In FIG. 8III the C-shape is shown to open when reclining. The loaded position is shown in bold between point C and point 1, whereas the old unloaded position is shown by a broken line between point C and point B. In FIG. 8IV the C-shape is shown to close when dismounting. The loaded position is shown in bold between point C and point 2, whereas the old unloaded position is shown by a broken line between point C and point B.

Figure 9:
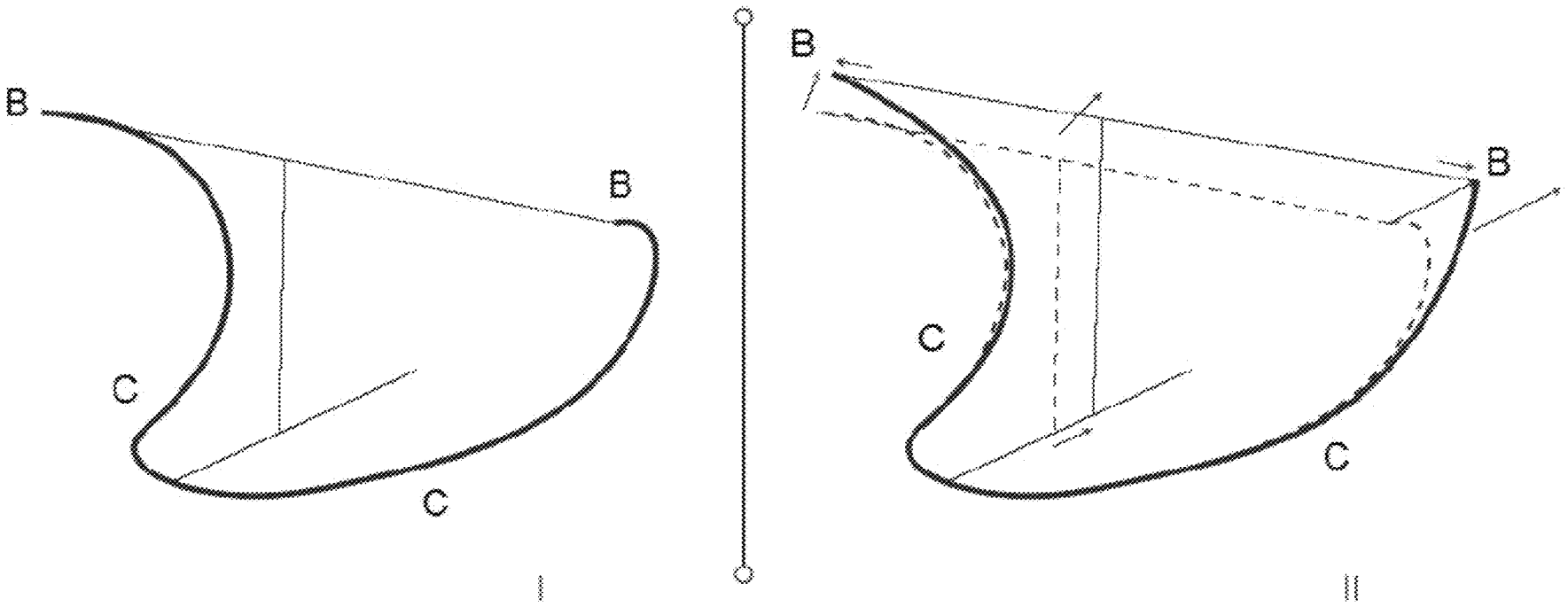
FIG. 9 is a perspective view of the opening of the lower section from FIG. 8III.

In FIG. 9 the shape of the lower section defined between points B and points Cs is shown in perspective as it moves from an unloaded position to a loaded position wherein the C-shape opens. In other words the radius of arcuate increases. In FIG. 9II the broken line represents the old unloaded position and the bold line represents the new loaded position.

Figure 10:
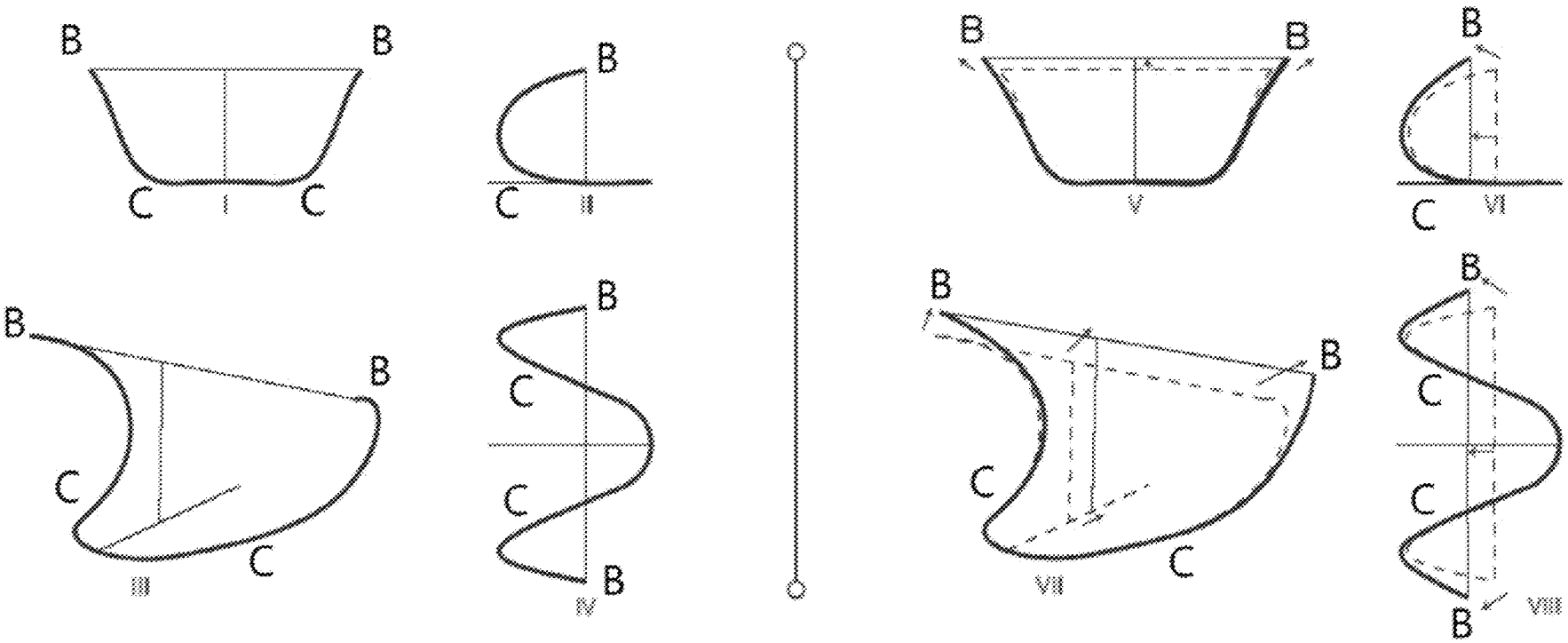
FIG. 10 shows multiple views of the shape of the lower section from FIG. 8 in an unloaded/closed and loaded/open condition.
Figure 11:
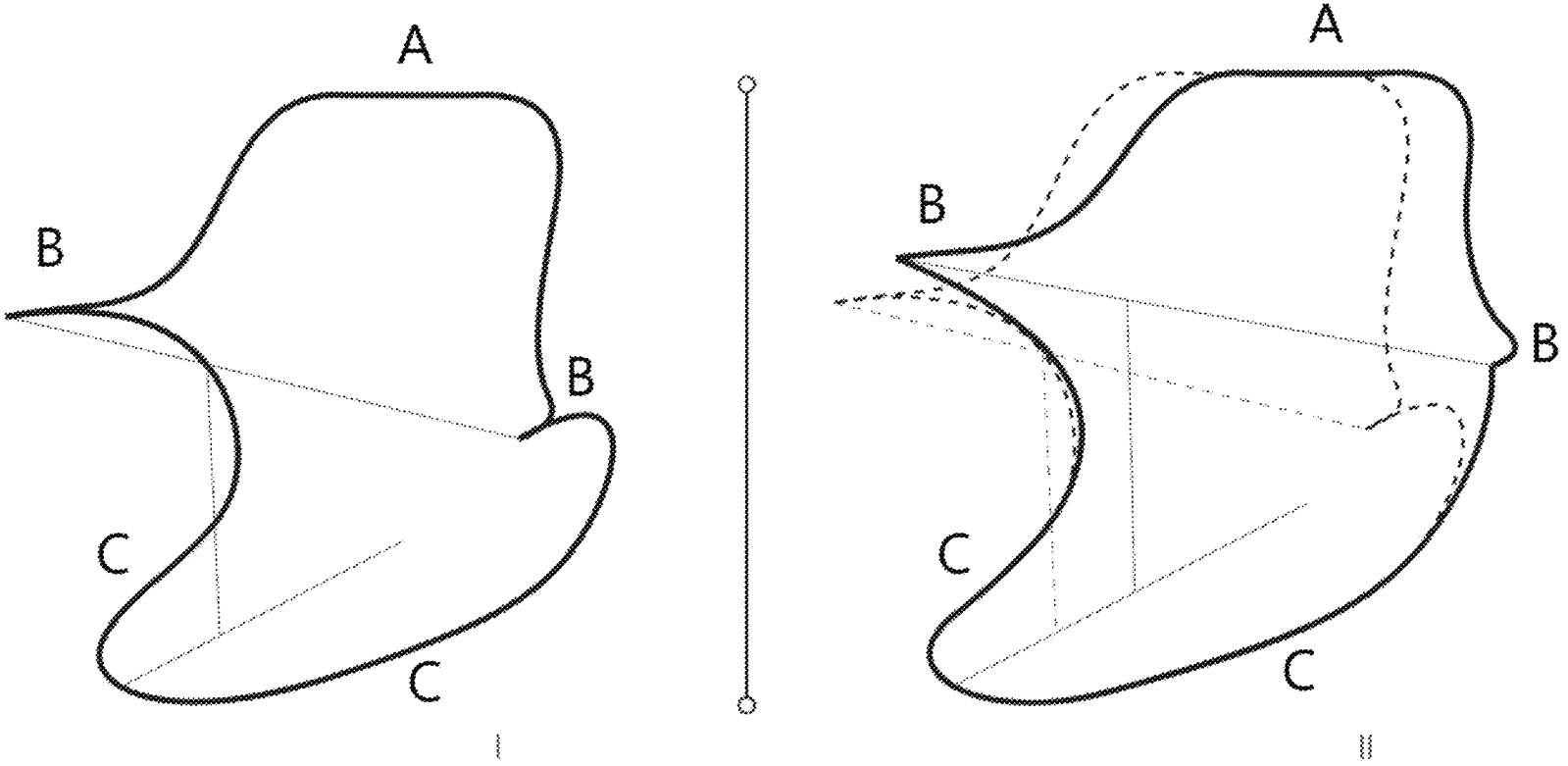
FIG. 11 is a perspective view of the shape of the chair back from FIG. 8 in an unloaded and loaded condition.

FIG. 10 parts I to IV shows the shape or form of the lower section of the chair back in front view, side view, perspective view, and plan view in an unloaded position. FIG. 10 parts V to VIII show the same views as the chair is loaded. The broken line represents the old unloaded position and the bold line represents the new loaded position. The displacement of each part is shown by arrows. In FIG. 10V point B is shown to undergo an upwards and outwards translation, reflecting the elbow rests opening outwards and upwards. In FIG. 10VI the lower section is shown to open reflecting the elbow rests also undergoing a backwards translation as the radius of curvature of the two resiliently flexible arcuate bands of the lower section increases. FIG. 10VII shows this also from a perspective view. FIG. 10VIII also shows the outward and backward translation of the elbow rest from a plan view. FIG. 11 shows a similar representation of the perimeter shape of the fall frame of the chair back, between an unloaded and loaded position. Again, the broken line represents the old unloaded position and the bold line represents the new loaded position. As the lower section of the frame opens, the back rest section follows.

Figure 12:
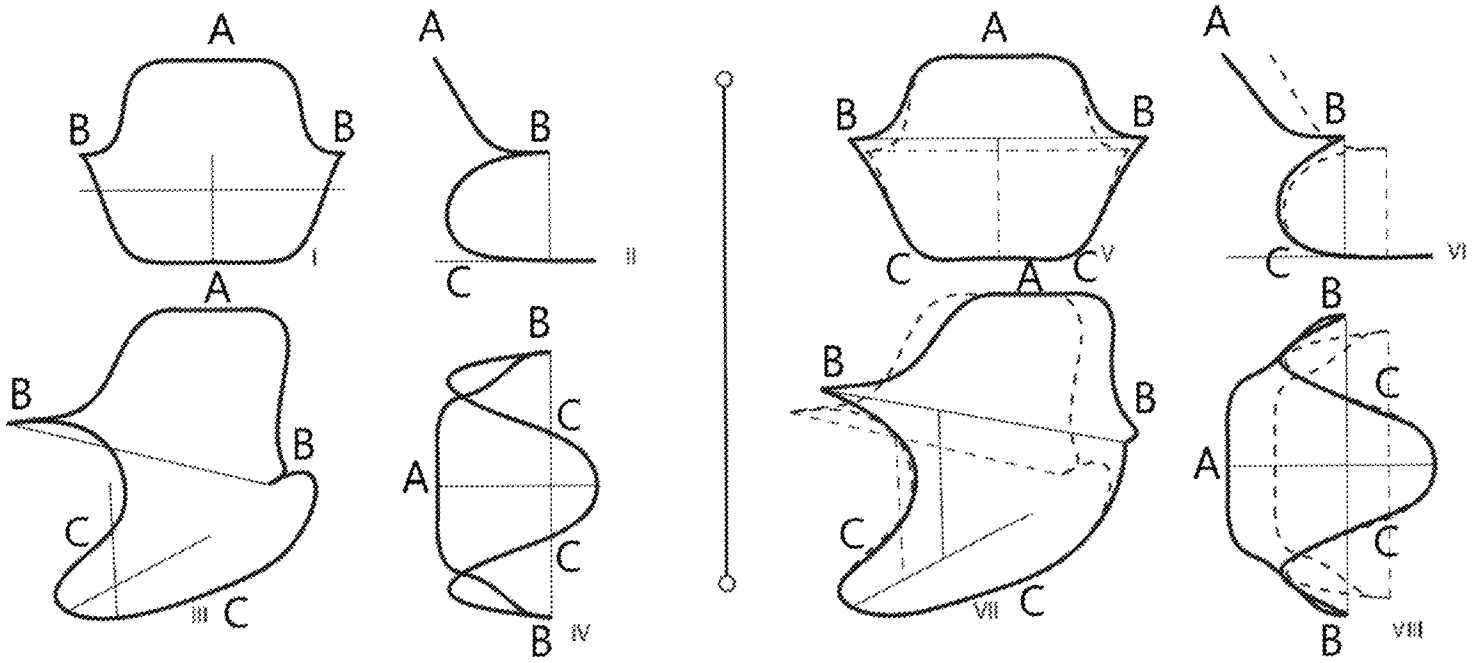
FIG. 12 shows multiple views of the shape of the chair back from FIG. 8 in an unloaded/closed and loaded/open condition.

FIG. 12 parts I to IV shows the shape or form of the perimeter of the full frame of the chair back in front view, side view, perspective view, and plan view.

FIG. 12 parts V to VIII show the same views as the chair is loaded. The broken line represents the old unloaded position and the bold line represents the new loaded position. As shown in FIG. 12V, the aforementioned opening or widening or separation of the elbow rests is unrestricted by the back rest section. The back rest section is adapted to facilitate the separation of the elbow rests. The side arms of the back rest section are adapted to flex relative to the central portion of the back rest section, so that the back rest section opens out as the lower section opens out. It will be appreciated that the back rest section can only open out so far before it restricts further opening of the lower section, and vice versa. FIGS. 12VI to 12VIII show how the back section also undergoes a backward translation. As best shown in FIG. 12V and FIG. 12VIII, the two elbow rests separate as the chair back is loaded. This is only possible as a result of the form of the upper section which allows the elbow rests to open out. For example, a flat bar between the elbow rests would prevent them from separating in this manner. However the C-shape of the lower section never fully unpeels as it is prevented from doing so by virtue of its connection to the upper section. As shown, the form of the lower section is similar to a helix thread, and that thread is prevented from unwinding by the upper section. The upper section keeps the lower section in tension. The lower section keeps the upper section in tension.

Figure 13:
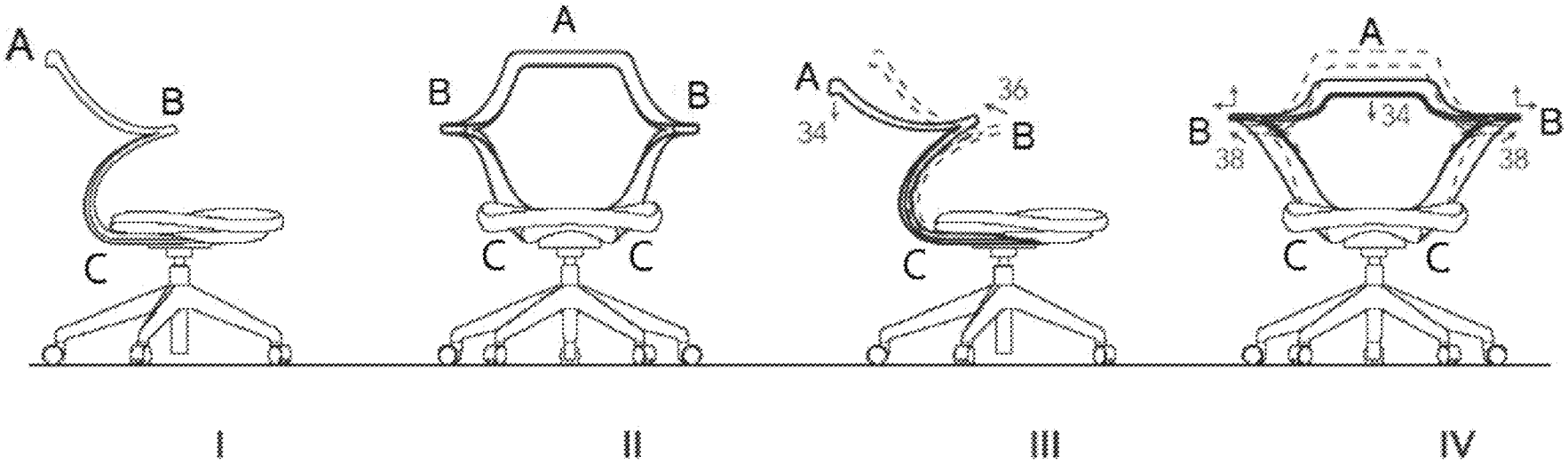
FIG. 13 shows side and front views of the chair back in accordance with one embodiment of the present invention in an unloaded and loaded condition.

FIG. 13I and FIG. 13II shows a side and front view of an embodiment of chair back in accordance with the present invention in use on a task chair. As shown the chair back has no back panel. In FIG. 13I and FIG. 13II, the chair is at rest. In FIGS. 13III and 13IV the chair is shown loaded. The broken line represents the old unloaded position and the bold line represents the new loaded position. The displacement of each section of the chair back is shown by arrows. lArrow 34 reflects the downward component of the translation of the central portion of the back rest section of the chair back at A. Arrow 36 reflects the upwards and backwards translation of the elbow rests 10 at B. Arrow 38 shows the upwards and outward (from the centre of the chair back) translation of the elbow rests 10 at B.

Figure 14:
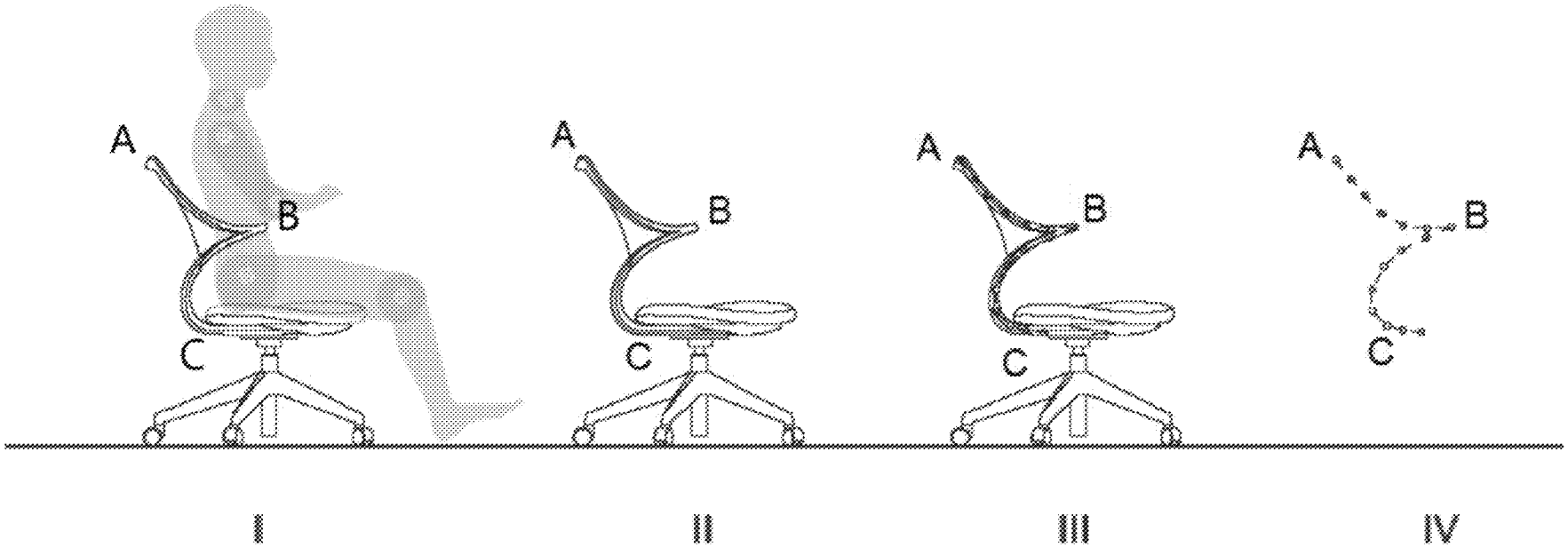
FIG. 14 is a side view of the chair of FIG. 8 in an in-use and vacant condition whilst in a neutral back rest position, and the displacement from a loaded position.

FIG. 14I shows an occupant in a neutral or disengaged backrest position. No force is applied through the chair back and the chair back remained static. In FIG. 14II the upper section is defined between point A and point B, and the lower back rest section defined between point B and point C.

Figure 15:
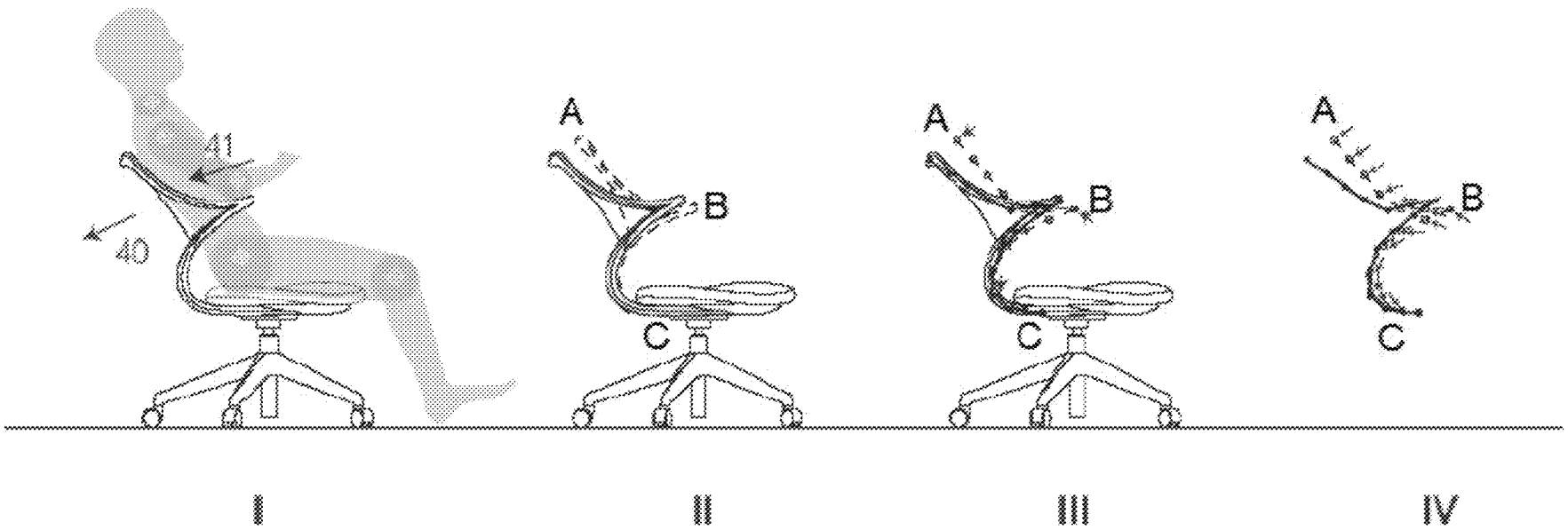
FIG. 15 is a side view of the chair of FIG. 8 in an in-use and vacant condition whilst in a natural resting position, and the displacement from a neutral backrest position.

FIG. 15I shows an occupant in a natural resting backrest position. A force is applied through the backrest section and the backrest section travels backwards, as shown by arrows 40 and 41. The displacement of the backrest section is shown in FIG. 15II wherein the bold line represents the natural resting position relative to the neutral/disengaged position represented by a broken line. Arrows show the displacement of points A and B. In FIG. 15IV, the shape of the perimeter of the frame of the chair back has been isolated to show displacement at multiple points between points A and B and B and C, as shown by the multiple arrows.

FIG. 16I shows an occupant in a fully reclined backrest position. A force is applied through the backrest section and the backrest section travels backwards, as shown by arrow 40. The displacement of the backrest section is shown in FIG. 16II wherein the bold line represents the fully reclined position relative to the neutral/disengaged position represented by a broken line. Arrows show the displacement of points A and B. In FIG. 16IV, the shape of the perimeter of the frame of the chair back has been isolated to show displacement at multiple points between points A and B and B and C, as shown by the multiple arrows.

FIG. 17I shows an occupant in dismounting backrest position. A force is applied to the elbow rests and the backrest section travels forwards, as shown by the arrows. The displacement of the backrest section is shown in FIG. 17II wherein the bold line represents the dismounting position relative to the neutral/disengaged position represented by a broken line. Arrows 42 and 44 show the displacement of points A and B. In FIG. 17IV, the shape of the perimeter of the frame of the chair back has been isolated to show displacement at multiple points between points A and B and B and C, as shown by the multiple arrows.

FIG. 18 shows various embodiments of the chair back of the present invention in use on a task chair. In FIG. 18I, no back panel is provided. In FIG. 18II a mesh back 46 panel is provided. In FIG. 8III a continuous back panel 48 is provided. In FIG. 8IV a fabric back panel 50 is provided. In FIGS. 8III and 8IV the back panel 46, 48, 50 extends onto the user engaging upper surface 14 of the elbow rests 10.

In use with a chair base or chair seat pan, the chair back provides a chair that promotes continuous, self-adjusted sitting that enables the occupant to achieve a variety of postures—from reclined, low sitting to upright, high perch sitting, with only one height adjustment lever on the chair base. This chair back relies on strategically configured bands (beams) which are preferably made from a resilient material. This preferred material is highly elastic and always returns to its original form, once unloaded. Once loaded by the weight of the user, it would deform and resiliently flex to the preferred style of position for the occupant.

The dynamic function of the chair back shown in the accompanying figures enables a flexion, which is sympathetic to the centre of balance of the occupant. To accomplish this, the back rest structural bands or beams extend symmetrically from both sides of the rear section of the chair, from under the seat pan. They progress rearward and upward in an arc to the point, at each side of the chair, where the approximate resting position for the occupants' elbows would rest. This position is an approximation of the occupants' centre of balance, which should lie above the height of their pelvis and forward of the horizontal distance of the occupants' ischial tuberosities. From this position, the chair back band changes direction and extends rearward and upward until it forms a seamless and seemingly unbroken, continuous structure. The band/frame can be manufactured from a single, unbroken component, or comprise of several joined components which are assembled to act as one continuous piece, which will act as one component under force.

To activate the recline function of the chair back, the occupant reclines backward on the seat, reclining. The force from their weight acts to flex the continuous band making up the frame of the chair back. The result is a band which moves backward partly as an arc from the top to the position of the elbow rest and partly as an arc from below the seat pan to the position of the elbow rest. The experienced movement is one of recline and relative horizontal displacement from the seat pan of the chair.

The present invention thus provides a back for a chair whereby the backrest reacts to the movement of the occupant's weight by displacing backward from specific locations, which are relevant to their natural body form movement requirements the claimed invention is a chair that promotes continuous, self-adjusted sitting that enables the occupant to achieve a variety of postures from reclined, low sitting to upright, high perch seating, with only one height adjustment lever required. This chair relies on strategically configured resiliently flexible bands which are made from a resilient material such as polypropylene or similar. This material is elastic and always returns to its original form, once unloaded. The shape of the bands can be achieved through injection moulding.

The chair offers a reclined/tilt function which enables the occupants to find natural region of dwell, during their reclined phase, which is unique to their weight and height. The bias of the chair is to the upright position, once the occupant dismounts. In doing so however this chair offers assistance to the user in rising out of the chair by the occupant pressing down on the elbow rest and in doing so pressing the backrest further forward than the neutral position. To enable control of the backrest recline it is necessary for the occupant to apply a greater force than the backrest can resist to remain static or return to its mutual rest position. Most occupant are capable of naturally applying such forces to overcome the natural rigidity of the beams (also referred to as rails or frame). The chair comprises of a paralysis of specific points, where flexion from these points enables the occupants to achieve a natural reclined sit while achieving a natural and controlled dwell.

The words "comprises/comprising" and the words "having/including" when used herein with reference to the present invention are used to specify the presence of stated features, integers, steps or components but does not preclude the presence or addition of one or more other features, integers, steps, components or groups thereof. It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A chair back comprising:

an upper back rest section formed from a single band having two ends, the upper back rest section comprising a back engaging surface and two side arms;

a lower section adapted to support the upper back rest section relative to a chair seat, wherein the lower section is formed from a pair of resiliently flexible arcuate bands, wherein an upper end of each arcuate band of the lower section is engaged with one of the ends of the single band of the upper back rest section to form an elbow rest; and wherein the back engaging surface of the upper back rest section lies in a substantially perpendicular plane to a plane in which an end of each of the two side arms lies at the elbow rests.

2. The chair back of claim 1, wherein the single band of the upper back rest section is a resiliently flexible band.

3. The chair back of claim 1, wherein the single band of the upper back rest section and the pair of resiliently flexible arcuate bands of the lower section are formed from a single resiliently flexible band.

4. The chair back of claim 1, wherein the pair of resiliently flexible arcuate bands of the lower section converge distal to the upper ends.

5. The chair back of claim 1, wherein a portion of an upper face of each resiliently flexible arcuate band engages or merges with a portion of an underside of a side section of the upper back rest section to form an elbow rest.

6. The chair back of claim 1, further comprising a back panel.

7. The chair back of claim 6, wherein the back panel has connection points to the upper back rest section, and to each resiliently flexible arcuate band of the lower section.

8. The chair back of claim 6, wherein the back panel is formed from a single piece of flexible material.

9. The chair back of claim 6, wherein the back panel is formed from a single piece of fabric.

10. The chair back of claim 6, wherein the back panel is formed from multiple strands.

11. The chair back of claim 10, wherein the multiple strands are multidirectional to form a net.

12. The chair back of claim 10, wherein the multiple strands are connected to at least one of the resiliently flexible arcuate bands by way of holes in the resiliently flexible arcuate band.

13. The chair back of claim 10, wherein the multiple strands have a first end and a second end, and the first end of the multiple strands converge to a first connection point on one of the resiliently flexible arcuate bands and the second end of the multiple strands converge to a second connection point on the other of the resiliently flexible arcuate bands.

14. The chair back of claim 6, wherein the back panel envelops a portion of the upper back rest section.

15. A chair comprising:

a seat section comprising a seat pan; and a chair back comprising:

an upper back rest section formed from a single band single band having two ends, the upper back rest section comprising a back engaging surface and two side arms;

a lower section adapted to support the upper back rest section relative to a chair seat, wherein the lower section is formed from a pair of resiliently flexible arcuate bands, wherein an upper end of each arcuate band of the lower section is engaged with one of the ends of the single band of the upper back rest section to form an elbow rest; and wherein the back engaging surface of the upper back rest section lies in a substantially perpendicular plane to a plane in which an end of each of the two side arms lies at the elbow rests.

16. The chair of claim 15, wherein the single band of the upper back rest section is a resiliently flexible band.

17. The chair of claim 15, wherein the single band of the upper back rest section and the pair of resiliently flexible arcuate bands of the lower section are formed from a single resiliently flexible band.

18. The chair of claim 15, wherein the pair of resiliently flexible arcuate bands of the lower section converge distal to the upper ends.

19. The chair of claim 15, wherein a portion of an upper face of each resiliently flexible arcuate band engages or merges with a portion of an underside of a side section of the upper back rest section to form an elbow rest.

20. The chair of claim 15, further comprising a back panel.

21. The chair of claim 20, wherein the back panel has connection points to the upper back rest section, and to each resiliently flexible arcuate band of the lower section.

22. The chair of claim 20, wherein the back panel is formed from a single piece of flexible material or fabric.

23. The chair of claim 20, wherein the back panel is formed from multiple strands.

24. The chair of claim 23, wherein the multiple strands are multidirectional to form a net.

25. The chair of claim 23, wherein the multiple strands are connected to at least one of the resiliently flexible arcuate bands by way of holes in the resiliently flexible arcuate band.

26. The chair of claim 23, wherein the multiple strands have a first end and a second end, and the first end of the multiple strands converge to a first connection point on one of the resiliently flexible arcuate bands and the second end of the multiple strands converge to a second connection point on the other of the resiliently flexible arcuate bands.

27. The chair of claim 20, wherein the back panel envelops a portion of the upper back rest section.

* * * * *